US007766191B2

(12) United States Patent
Jackson et al.

(10) Patent No.: US 7,766,191 B2
(45) Date of Patent: Aug. 3, 2010

(54) EPOXY SYRINGE STORAGE CLIP

(75) Inventors: Scott Jackson, Olmsted Township, OH (US); Rhonda Williams, Avon, OH (US)

(73) Assignee: Henkel Corporation, Rocky Hill, CT (US)

( * ) Notice: Subject to any disclaimer, the term of this patent is extended or adjusted under 35 U.S.C. 154(b) by 952 days.

(21) Appl. No.: 11/548,708

(22) Filed: Oct. 12, 2006

(65) Prior Publication Data

US 2007/0129672 A1 Jun. 7, 2007

Related U.S. Application Data

(60) Provisional application No. 60/726,569, filed on Oct. 14, 2005.

(51) Int. Cl.
*B67D 3/00* (2006.01)

(52) U.S. Cl. ..... 222/137; 222/145.5; 222/530; 222/538; 215/390; 220/255; 366/337; 604/82

(58) Field of Classification Search ..... 222/132, 222/137, 145.6, 530, 538, 326–327; 366/239, 366/337; 604/82; 239/413; 15/323; 215/389, 215/229; 220/8, 255, 708
See application file for complete search history.

(56) References Cited

U.S. PATENT DOCUMENTS

| | | | | |
|---|---|---|---|---|
| 1,426,846 | A * | 8/1922 | Craig | 222/192 |
| 4,753,536 | A | 6/1988 | Spehar et al. | |
| 4,767,026 | A | 8/1988 | Keller et al. | |
| 4,995,540 | A * | 2/1991 | Colin et al. | 222/132 |
| 5,105,958 | A * | 4/1992 | Patton | 215/388 |
| 5,333,760 | A * | 8/1994 | Simmen | 222/137 |
| 5,388,712 | A * | 2/1995 | Brody | 215/229 |
| 5,601,216 | A | 2/1997 | Visco | |
| 5,609,271 | A | 3/1997 | Keller et al. | |
| 5,725,499 | A * | 3/1998 | Silverstein et al. | 604/82 |
| 5,918,772 | A | 7/1999 | Keller et al. | |
| 6,131,775 | A * | 10/2000 | Brody | 222/211 |
| 6,527,203 | B2 * | 3/2003 | Hurray et al. | 239/413 |
| 6,615,442 | B2 * | 9/2003 | Yang | 15/323 |
| 6,698,622 | B2 * | 3/2004 | Sawhney et al. | 222/137 |
| 6,773,156 | B2 | 8/2004 | Henning | |
| 6,813,806 | B2 * | 11/2004 | Martinez | 15/323 |
| 6,832,408 | B2 * | 12/2004 | Roney et al. | 15/323 |
| 2002/0170926 | A1 * | 11/2002 | Horner et al. | 222/137 |
| 2003/0048694 | A1 | 3/2003 | Horner et al. | |
| 2004/0008576 | A1 | 1/2004 | Henning | |

OTHER PUBLICATIONS

International Search Report of PCT/US06/40110, dated Jul. 31, 2007.

* cited by examiner

*Primary Examiner*—Kevin P Shaver
*Assistant Examiner*—Andrew P Bainbridge
(74) *Attorney, Agent, or Firm*—James E. Piotrowski

(57) ABSTRACT

A dispensing system for simultaneously dispensing a plurality of reactive materials. The system includes a multiple-barreled syringe having at least two barrels joined by a flange and containing respective different reactive materials. Parallel plungers joined by a flange force sealing members through the barrels to discharge the materials. A static mixer element having an applicator attaches to the syringe, and a means for re-sealing the syringe for subsequent use is provided. A sliding clip engaging a complementary shape removably fixes a loose static mixer element to the syringe, reducing the risk of misplacement and loss.

7 Claims, 5 Drawing Sheets

EPOXY SYRINGE STORAGE CLIP

CROSS REFERENCE TO RELATED APPLICATIONS

This application claims priority under 35 U.S.C. §119 of U.S. Provisional Application No. 60/726,569, filed Oct. 14, 2005.

BACKGROUND OF THE INVENTION

The present invention relates to dispensing syringes for simultaneously discharging a plurality of reactive fluids. Syringes of this type are generally designed to dispense liquid or semi-liquid materials in a predetermined ratio. Materials requiring this mode of application include reactive, two-component adhesives, sealants, and coatings, as well as co-dispensed materials combining an adhesive or sealant and a colorant paste. Typical materials formed from reactive multi-component mixtures include epoxies, acrylics, silicones, polyesters, and urethanes.

Devices for simultaneously dispensing such reactive materials, particularly for smaller quantities of materials for use in consumer applications, typically comprise a syringe having two parallel, cylindrical bores or barrels filled with the reactants, with two joined plungers or pistons that fit into the barrels. In the filled and assembled device, the plungers are pre-fitted into the barrels to seal the contents until use. In use, the plungers are manually forced into one end of the bores to cause the materials to flow out a nozzle or nozzles at the other end of the bores. The nozzle or nozzles are sealed with frangible or removable seals molded or fitted on the nozzle ends, which are severed or removed by the user to permit the barrel contents to flow out. A cap or other resealing apparatus is provided to re-seal the nozzle or nozzles until the next use.

In order to form a uniformly composed cured product, the dispensed components must be adequately mixed to form a homogeneous reaction mixture. Simpler devices having separate nozzles for each reactant require the user to mix the dispensed components in-situ on the application site, or on a separate mixing site prior to application, using a stirring rod or other suitable mixing tool, which may double as an applicator. This approach, while keeping the dispenser simple, is not always practical for dispensing small quantities in a precise manner as called for frequently in consumer applications. The user typically has to dispense more than is needed for the application, leading to waste. The excess material also presents hazards due to spillage, contamination, exposure, and disposal.

In an alternate approach, the dispensing syringe is provided with a static mixing element that fits onto the open nozzle or nozzles. The mixing element forces the reactive components into an intimate mixture that can be applied directly from an exit nozzle on the mixer. This type of device significantly improves the ability of the user to meter and precisely apply small quantities of the reactive mixture, while at the same time significantly reducing the hazards associated with manual mixing. The static mixing element can only be used for a single application, since the reactive mixture within it cannot be flushed and will cure to clog it permanently. On the other hand, the syringes are nearly always filled with a sufficient quantity of reactants for more than one application. Therefore the devices are sold in a single package with two or more disposable static mixers for multiple uses.

A recurrent issue with these systems involves the inadvertent separation of the syringe assembly from an unused static mixer. Of necessity the mixers are separate or separable from the syringe assembly so to be attached to the open nozzle or nozzles. The risk exists that during use or subsequent storage the unused static mixer will become permanently separated from the syringe assembly and thereby impair the system's utility. A related problem is the loss of the cap or other re-sealing means to preserve the reactants for subsequent applications while the system is stored prior to re-use. For simplicity the cap is often frangibly molded together with the syringe body or plunger assembly and is broken off for use. The small size of the caps renders them particularly susceptible to misplacement and loss, exposing the contents of the barrels to degradation and spillage.

SUMMARY OF THE INVENTION

Thus the present invention provides a dispensing system for simultaneously dispensing a plurality of reactive materials, comprising:

(a) a multiple-barreled syringe having an outlet or outlets at an outlet end through which can flow the reactive materials, at least two barrels containing a respective different reactive material, the barrels being conjoined at second ends thereof distal to the outlet end by a flange;

(b) a plurality of parallel plungers equal in number to the barrels, conjoined by a flange at first ends thereof against which manual pressure may be applied to force sealing members disposed at second ends thereof through the barrels to discharge the materials from said barrels;

(c) a plurality of static mixer elements, each capable of being sealingly attached at an inlet to the syringe outlet or outlets such that the reactive materials flow simultaneously from the barrels through the outlet or outlets into the static mixer element inlet, the static mixer element having an applicator at a distal end;

(d) a means for re-sealing the syringe outlet or outlets for subsequent use; and (e) the syringe comprising a fixing element for removably fixing a loose static mixer element to the syringe.

In one embodiment of the system according to the invention, the syringe is a dual-barreled syringe. The re-sealing sealing means comprises a cap, a plug, a plunger, a pin, or a stopper, generally any of the known devices for re-sealing open orifices. The fixing element can be any type of clip or snap or fastener that will secure a static mixer or other accessory to the syringe body such that it will not become separated easily during normal use and storage of the device. Preferably the fixing element comprises a sliding clip that slidingly engages a complementary shape on the static mixer element to secure it to the syringe, like, the mortise and tenon of a dovetail joint. The sliding clip can take a variety of geometric cross-sectional forms, such as rectangular, T-shaped, V-shaped, circular ovoid, triangular, or any other shape capable of securing the static mixer element to the syringe by slidingly engaging a complementary shape on the mixer element. Additional fixing elements can be provided for additional static mixer elements or for attaching the re-sealing means such as a cap, or any other loose accessory of the system, to the syringe or another element of the dispensing system. The fixing means may take many forms. A loop or hole may be provided, into which a loose element may be inserted and held. Claw type fasteners may be used. Fixed plugs may be provided that insert into an open end of the mixer or cap elements to fasten them to the syringe. Alternatively a plug can be located on any component in such a way to provide fixing engagement with complementary recess on another component.

In another embodiment the fixing element comprises a sliding clip having a T-shaped cross-sectional profile, the complementary female shape being a T-shaped slot or groove. Location of the complementary male and female shapes comprising the fixing element, as between the main body of the syringe and the accessory to be attached, is a matter of choice. In another embodiment the male portion of the clip is located on the outside of the syringe, preferably adjacent the flange joining the barrels. In another embodiment, the static mixer is secured in a generally parallel direction to the barrels so as not to interfere with manipulation of the device during use. The invention may be understood more fully by reference to the drawings, which are submitted for illustration only and are not intended to define the scope of the invention.

DETAILED DESCRIPTION OF THE INVENTION

Figure 1:
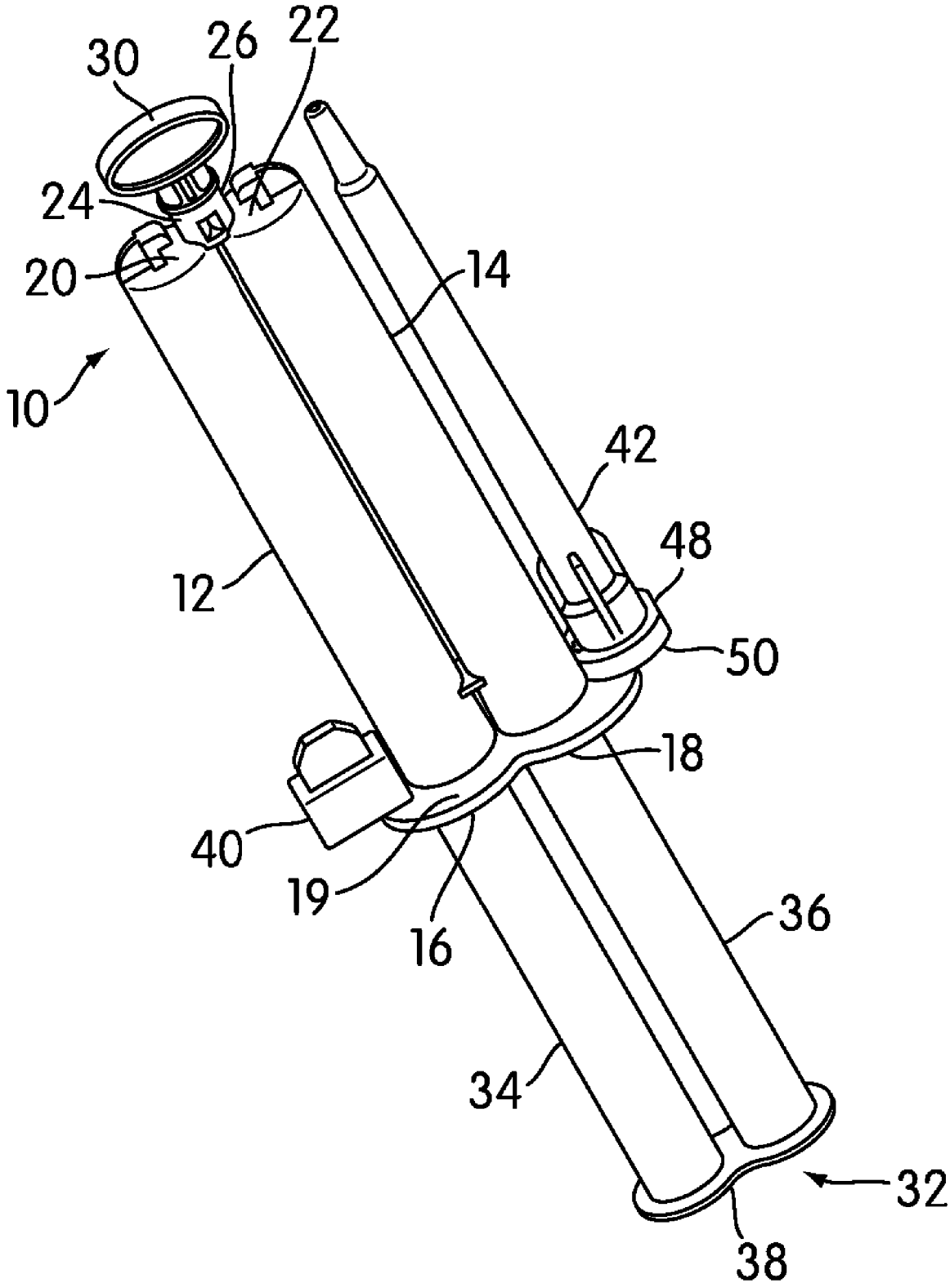
FIG. 1 is a perspective view of a dual-barrel dispensing system according to the invention, showing the static mixer and re-sealing cap clipped to the syringe.
Figure 2:
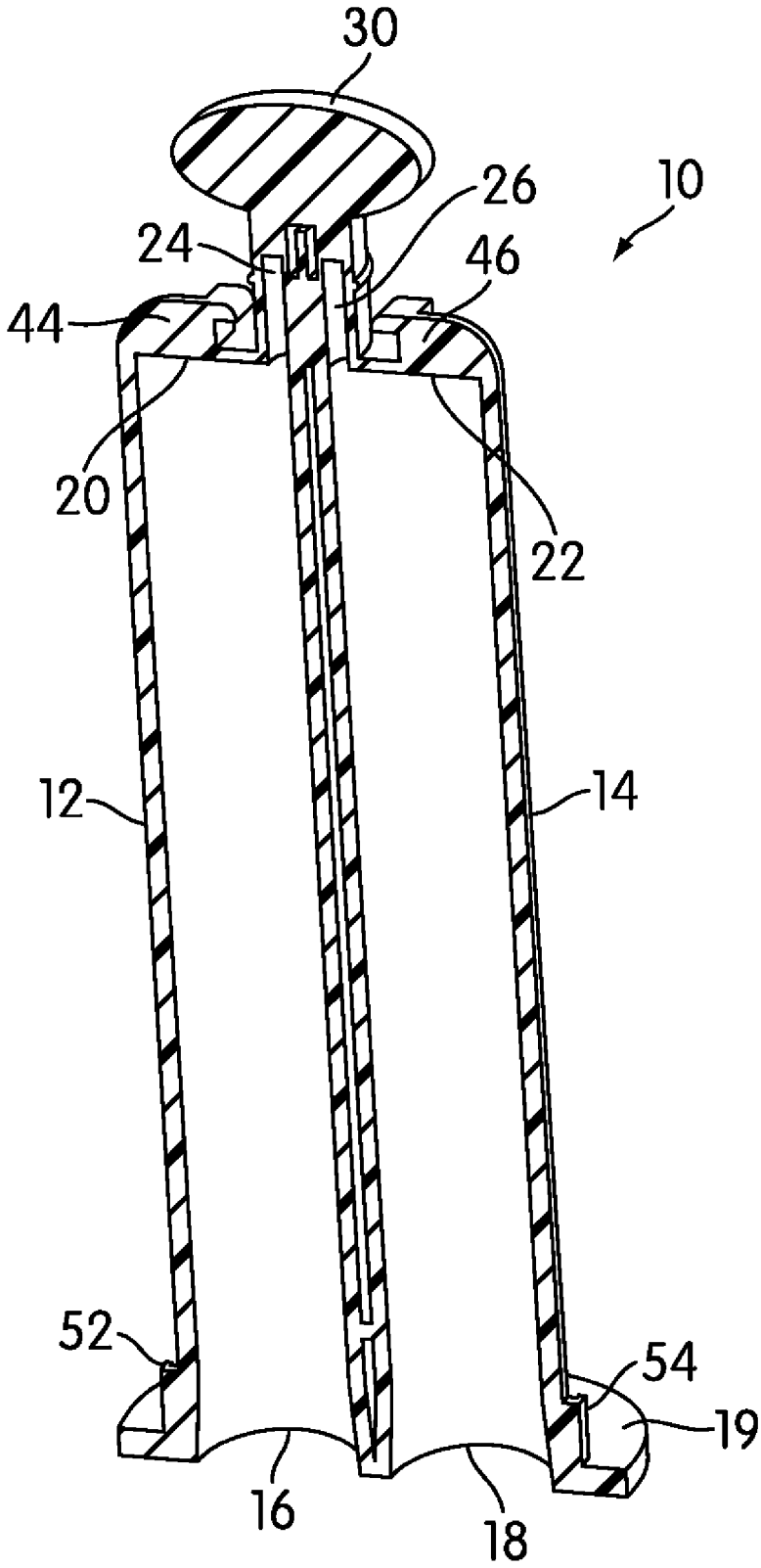
FIG. 2 is a perspective view, in cross-section, of the syringe of FIG. 1 with the static mixer, cap, and plungers removed, and showing the male portions of the clips for holding the cap and mixer.

Referring now to the drawings, FIG. 1 illustrates a dual-barreled syringe having a syringe body 10 including two parallel, cylindrical hollow barrels 12 and 14 having respective filling ends 16 and 18 joined by flange 19 and closed outlet ends 20 and 22, from which extend outlets 24 and 26. Barrels 12 and 14 are joined at filling ends 16 and 18 by a flange 28. A frangible tab 30 seals the outlets 24 and 26. In use the tab 30 is broken off to unseal the outlets 24 and 26 and permit the barrel contents to be discharged. The dual plunger assembly 32 having plungers 34 and 36 joined by flange 38 is shown with the plungers 34 and 36 inserted into the filling ends 16 and 18 of barrels 12 and 14. A cap 40 for re-sealing the outlets 24 and 26 and a static mixing element 42 are shown clipped respectively to barrels 12 and 14. With the exception of the static mixing element 42, all of the elements of the dual-barreled syringe can be and typically are molded together in a single conventional injection molding process from a suitable polymeric material such as polypropylene Referring now to FIG. 2, the syringe body 10 is shown in longitudinal cross-section, bisected through both barrels 12 and 14 and showing the communication of outlets 24 and 26 with the respective interiors of barrels 12 and 14 through outlet ends 20 and 22. Also shown in the view of FIG. 2 is the frangible sealing of outlets 24 and 26 by the integrally-molded tab 30. While the tear-away tab arrangement depicted in FIG. 2 is preferred for simplicity of manufacture, other sealing means such as plugs, screw caps, pins, or stoppers may be used. In addition, the tab 30 may be formed in multi-functional configuration, doubling as a cap or other means for resealing the syringe outlets after opening, or as an applicator, a brush, or other accessory contemplated as useful in the application of the chosen reactive materials.

Figure 3:
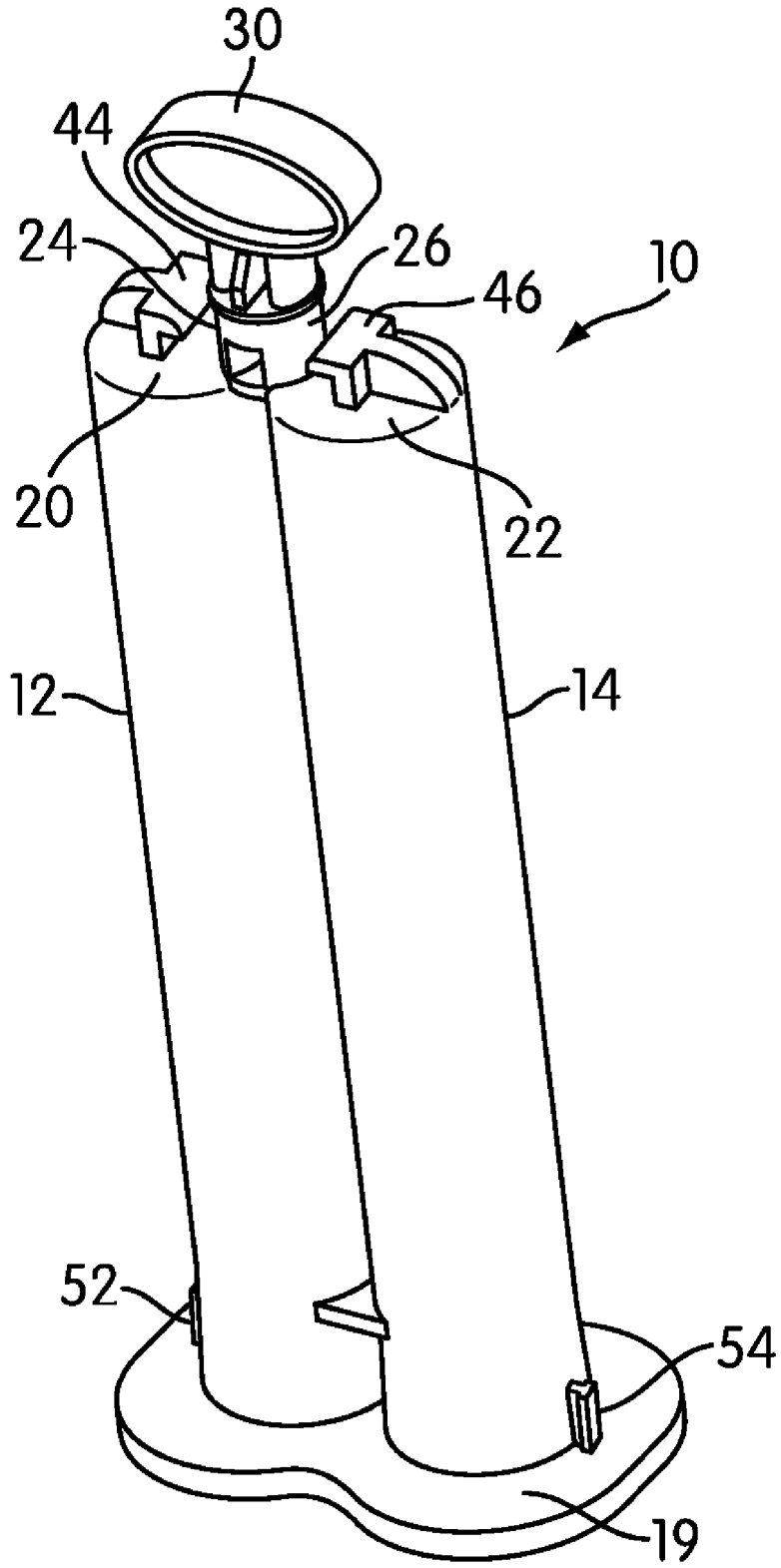
FIG. 3 is a perspective view of the syringe of FIG. 1 with the static mixer, cap, and plungers removed, and showing the male portions of the clips for holding the cap and mixer.

FIG. 3 is a perspective view of the syringe body 10. Both FIG. 2 and FIG. 3 show locking shoulders 44 and 46 that cooperate with a flange 48 at the inlet end 50 of the static mixer 42 to lock and seal the static mixer 42 upon the syringe outlets 24 and 26. At the opposite ends of the syringe body 10, each barrel 12 and 14 has sliding clips 52 and 54 running generally parallel to the barrels 12 and 14 and abutting the flange 19 joining the barrels at their inlet ends 16 and 18.

Figure 4:
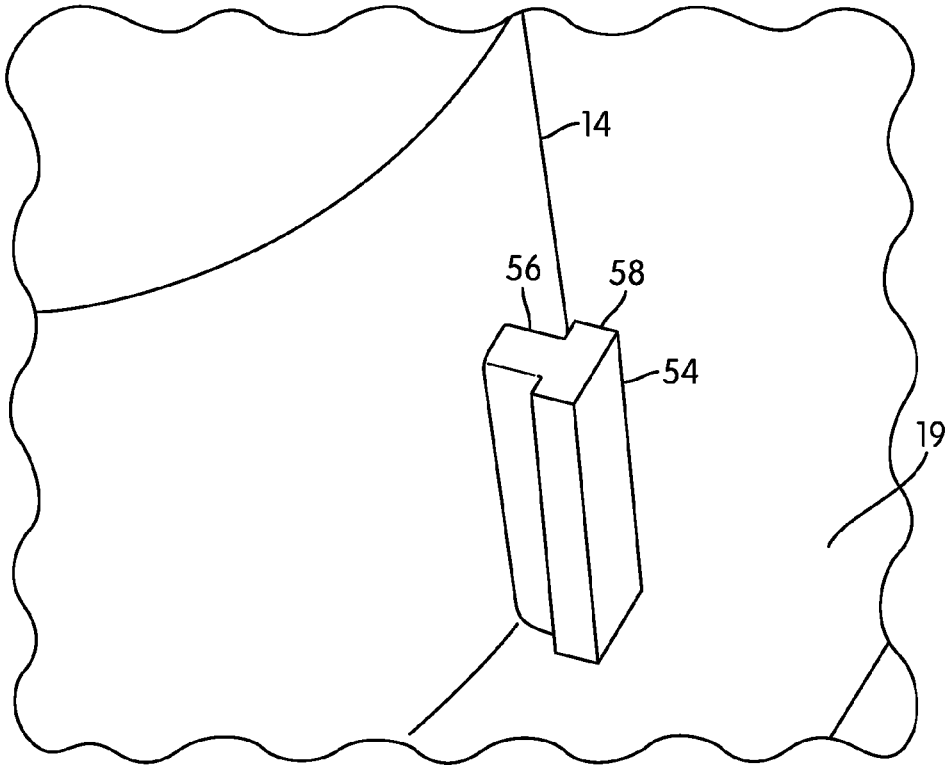
FIG. 4 is a close-up perspective view of the male portion of the T-shaped sliding clip, located on the outside edge of the syringe barrel, abutting the inner edge of the flange joining the syringe barrels, and running generally parallel to the barrels.

FIG. 4 is a close-up perspective of the sliding clip 54. In the embodiment depicted in FIG. 4 the sliding clip has a T-shaped cross-sectional profile comprising a rectangular pedestal portion 56 joined perpendicularly at one end to a cross portion 58 and at the other to barrel 14. The clip 54 therefore assumes the form of a T-shaped prism.

Figure 5:
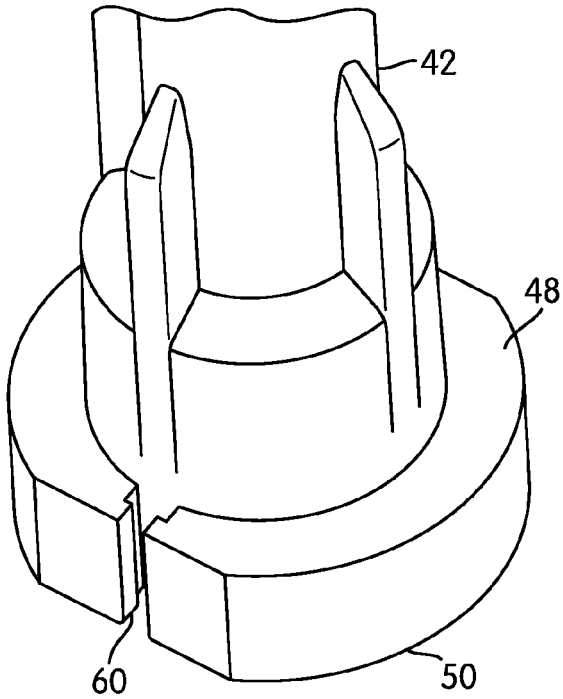
FIG. 5 is a close-up perspective view of the inlet end of the static mixer element, showing the complementary, T-shaped female groove, located at the edge of a flange on the mixer inlet end, which cooperates with the male portion of the clip on the syringe barrel.

FIG. 5 is a close-up perspective view of the inlet end 50 of static mixer 42. Flange 48 is provided with a T-shaped groove 60 that is complementary to and slidingly engageable with sliding clip 54. The fit between the clip 54 and groove 60 is sufficiently tight to securely fasten the static mixer 42 during use or storage condition, yet sufficiently relaxed to permit the mixer 42 readily to be attached to and removed from the barrel 14.

Figure 6:
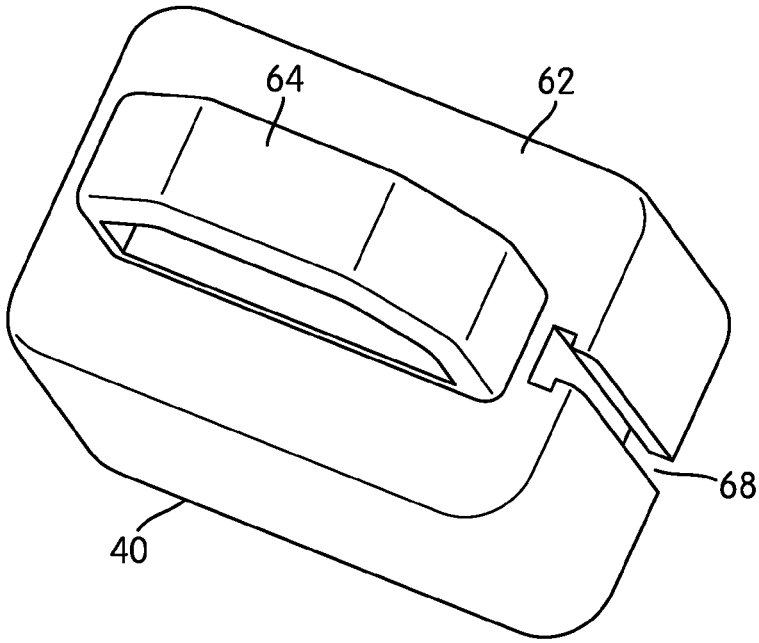
FIG. 6 and FIG. 7 are respective top and bottom perspective views of the re-sealing cap, showing the complementary, T-shaped female groove located at the edge of the cap, which cooperates with the male portion of the clip on the syringe barrel.
Figure 7:
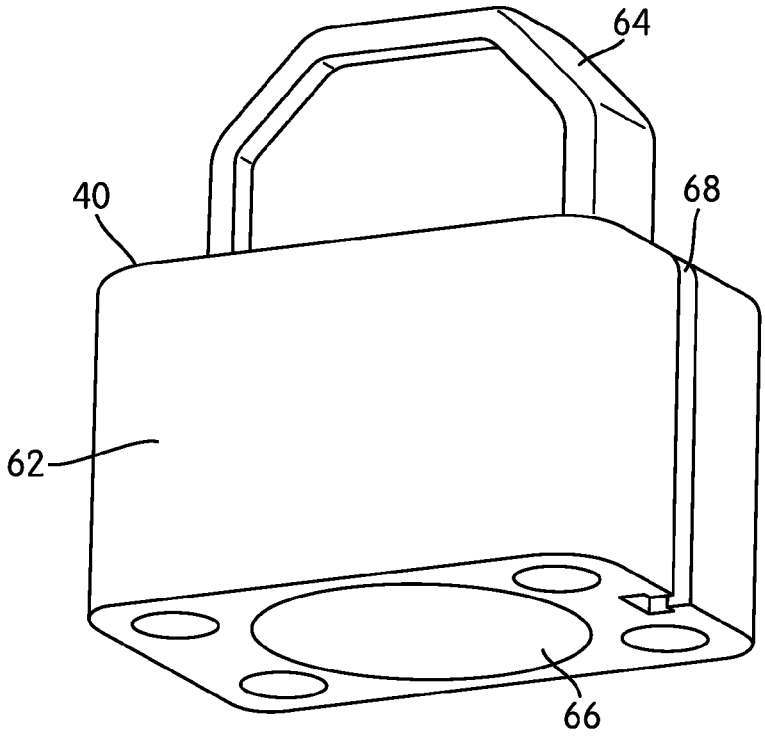

FIG. 6 and FIG. 7 are perspective views of cap 40 that re-seals the opened outlets 24 and 26. The cap 40 has a body 62, a handle 64 located on the top of the body 62, and a bore 66 in the underside of the cap body 62 that sealingly engages the outlets 24 and 26 of the syringe barrels 12 and 14. Cap body 62 is provided with a T-shaped groove 68 that is complementary to and slidingly engageable with sliding clip 52. The fit between the clip 52 and groove 68 is sufficiently tight to securely fasten cap 40 to the syringe body during use or storage, yet sufficiently relaxed to permit the cap 40 readily to be attached to and removed from the barrel 12.

As used herein, and in particular as used herein to define the elements of the claims that follow, the articles "a" and "an" are synonymous and used interchangeably with "at least one" or "one or more," disclosing or encompassing both the singular and the plural, unless specifically defined otherwise. The conjunction "or" is used herein in its inclusive disjunctive sense, such that phrases formed by terms conjoined by "or" disclose or encompass each term alone as well as any combination of terms so conjoined, unless specifically defined otherwise.

Changes may be made to the above system without departing from the scope of the invention. All matter contained in this description or shown in the drawings is intended to illustrate and not limit the invention claimed.

What is claimed:

1. A dispensing system for simultaneously dispensing a plurality of reactive materials, comprising:

a syringe body having a plurality of barrels with opposing first and second ends and at least a first and second fixing elements mounted distal to the first end of the syringe body, each barrel having an interior volume fluidly connected to an outlet adjacent the first end, the barrels being joined at the second ends by a flange;

a plurality of parallel plungers, each plunger having a sealing member mounted at a first end and disposed within a barrel interior volume, each plunger joined to the others by a flange at a second end, wherein manual pressure may be applied by a user to the flange to force the sealing members through the barrels to discharge compositions from the barrels;

a static mixer including a connecting element integral to the mixer, an inlet attachable to the syringe outlet, an outlet, a fluid pathway between the inlet and the outlet and a mixing element in the fluid pathway, the mixer having a first use position where the mixer inlet is fluidly coupled to the syringe body outlet and a second storage position where the mixer inlet is displaced from the syringe outlet and the connecting element attaches to one of said fixing elements and a plug for selectively sealing the syringe body outlet, the plug including a connecting element integral with the plug, the plug having a first use position sealingly attached to the syringe outlet and a second storage position where the plug is displaced from the outlet and the connecting element attaches to one of said fixing elements to removably fix the plug to the syringe body.

2. The system of claim 1 comprising a tab frangibly attached to the syringe body to seal the syringe body outlet, the tab being removable.

3. The system of claim 1 further comprising a first composition in one syringe barrel and a second composition in another syringe barrel, wherein the first and second compositions can be mixed to form a curable composition.

4. The system of claim 1 wherein the first and second fixing elements are mounted adjacent the syringe body flange.

5. The system of claim 1 wherein the first and second fixing elements comprise a shape and the static mixer connecting element and plug connecting element each comprise a complementary shape slidingly engageable with one fixing element shape.

6. The system of claim 1 wherein each fixing element comprises a tongue or groove, the static mixer connecting element comprises a complementary shape selectively engageable with one fixing element; and the plug connecting element comprises a complementary shape selectively engageable with one of the fixing elements.

7. The system of claim 1 wherein the fixing elements comprise a T shape projecting from the syringe body adjacent the syringe body flange; the static mixer connecting element defines a T shaped groove selectively engageable with one of the fixing elements to removably fix the static mixer to the syringe body in the storage position; and the plug connecting element comprises a T shaped groove selectively engageable with one of the fixing elements to removably fix the plug to the syringe in the storage position.

* * * * *